US011511830B2

(12) United States Patent
Gilpin

(10) Patent No.: US 11,511,830 B2
(45) Date of Patent: Nov. 29, 2022

(54) STANDUP PADDLEBOARD SEAT ASSEMBLY

(71) Applicant: Ash Gilpin, Virginia Beach, VA (US)

(72) Inventor: Ash Gilpin, Virginia Beach, VA (US)

( * ) Notice: Subject to any disclaimer, the term of this patent is extended or adjusted under 35 U.S.C. 154(b) by 106 days.

(21) Appl. No.: 17/142,606

(22) Filed: Jan. 6, 2021

(65) Prior Publication Data

US 2021/0214053 A1 Jul. 15, 2021

Related U.S. Application Data

(60) Provisional application No. 62/959,490, filed on Jan. 10, 2020.

(51) Int. Cl.
*B63B 32/40* (2020.01)
*B63B 32/77* (2020.01)

(52) U.S. Cl.
CPC ..... *B63B 32/40* (2020.02); *B63B 32/77* (2020.02)

(58) Field of Classification Search
CPC ..... B63B 32/00; B63B 32/40; B63B 32/60; B63B 32/77; B63B 7/085
USPC ..... 441/65, 68, 72, 74; 114/363
See application file for complete search history.

(56) References Cited

U.S. PATENT DOCUMENTS

| | | | | |
|---|---|---|---|---|
| 6,035,799 | A * | 3/2000 | Lukanovich | B63B 32/56 441/74 |
| 8,752,492 | B1 | 6/2014 | Harris | |
| 9,643,696 | B1 | 5/2017 | Lockhart et al. | |
| 10,196,113 | B2 * | 2/2019 | Mellina | B63B 32/70 |
| 10,494,066 | B1 | 12/2019 | Garcia | |
| 11,001,348 | B2 * | 5/2021 | Yandow | B63B 32/77 |
| 2011/0088610 | A1 | 4/2011 | Wood | |
| 2013/0189885 | A1 | 7/2013 | Wood et al. | |
| 2018/0065718 | A1 | 3/2018 | Isom | |

* cited by examiner

*Primary Examiner* — Daniel V Venne
(74) *Attorney, Agent, or Firm* — Allen, Dyer et al.

(57) ABSTRACT

A standup paddleboard (SUP) seat assembly for securing to an SUP includes a seat, an upper post having the seat mounted on an upper end of the upper post, and a lower post. The upper post is configured to extend from the lower post in order to adjust a height of the seat. The seat assembly also includes a bracket secured to a lower end of the lower post, and a base plate having a lower surface and an upper surface. The base plate is secured to the lower post via the bracket. In addition, the seat assembly includes a plurality of suction cups secured to the lower surface of the base plate, where the plurality of suction cups is configured to be secured to a top surface of an SUP, and a strap and configured to be wrapped around the SUP and tightened.

20 Claims, 7 Drawing Sheets

STANDUP PADDLEBOARD SEAT ASSEMBLY

CROSS-REFERENCE TO RELATED APPLICATIONS

This application claims the benefit of U.S. provisional application No. 62/959,490 filed Jan. 10, 2020, which is hereby incorporated herein in its entirety by reference.

FIELD

The present invention relates to the field of standup paddleboard accessories, and, more particularly, to a standup paddleboard seat assembly.

BACKGROUND

Standup paddleboards (SUP) are similar to surfboards. However, in contrast to a surfboard where the user lies down and paddles with their hands, an SUP user stands on the board and paddles from a standing position. Accordingly, the user often gets tired from standing for long periods of time on the SUP and has to sit down on the SUP, which can be difficult and uncomfortable for some users.

The SUP also makes a good platform for fishing while standing and to be able to access shallow water areas that boats cannot. Again, standing for long periods of time on the SUP can make the experience unpleasant for some users. Sitting down on the SUP makes casting and scouting for the fish difficult so that the user must stand.

Thus, there is a need for a device that allows the SUP user to take a rest or to maintain a comfortable position on the SUP without sitting on the SUP itself.

SUMMARY

A standup paddleboard seat assembly is disclosed. The seat assembly includes a seat having a horizontal portion configured for a user to sit, and an upper post having a height adjustment pin. The seat is mounted on an upper end of the upper post. The seat assembly also includes a lower post. The lower post and the upper post may each comprise anodized aluminum or carbon fiber. A seat bracket and a seat bolt rotatably secure the upper post to the seat. A storage bag may be secured to the seat to store personal items of a user when paddleboarding. The seat may comprise textured plastic or carbon fiber.

The upper post is configured to extend from the lower post in order to adjust a height of the seat and be secured with the height adjustment pin. The seat assembly includes a bracket secured to a lower end of the lower post, and a base plate having a lower surface and an upper surface and secured to the lower post via the bracket. The bracket may include a first side and a spaced apart second side having a bolt extending therebetween where the lower post rotatable secured to the bracket via the bolt.

In addition, the seat assembly includes a plurality of suction cups, where the plurality of suction cups is configured to be secured to a top surface of an SUP, and the seat assembly also includes a strap having a first end and a second end.

The strap is secured to the base plate and configured to be wrapped around the SUP and tightened so that the base plate is secured to the SUP. The strap has a first end and a second end so that the strap can be secured to the base plate using the first end of the strap having a fixed loop and the opposing second end of the strap having a locking buckle. The strap is configured to be wrapped around the SUP and tightened using the locking buckle. In a particular aspect, the base plate has a rear portion behind where the bracket is secured and facing towards a rear of the SUP so that the strap is secured to the base plate at the rear portion and behind the bracket.

Other aspects, advantages, and features of the present disclosure will become apparent after review of the entire application, including the following sections: Brief Description of the Drawings, Detailed Description, and the Claims.

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
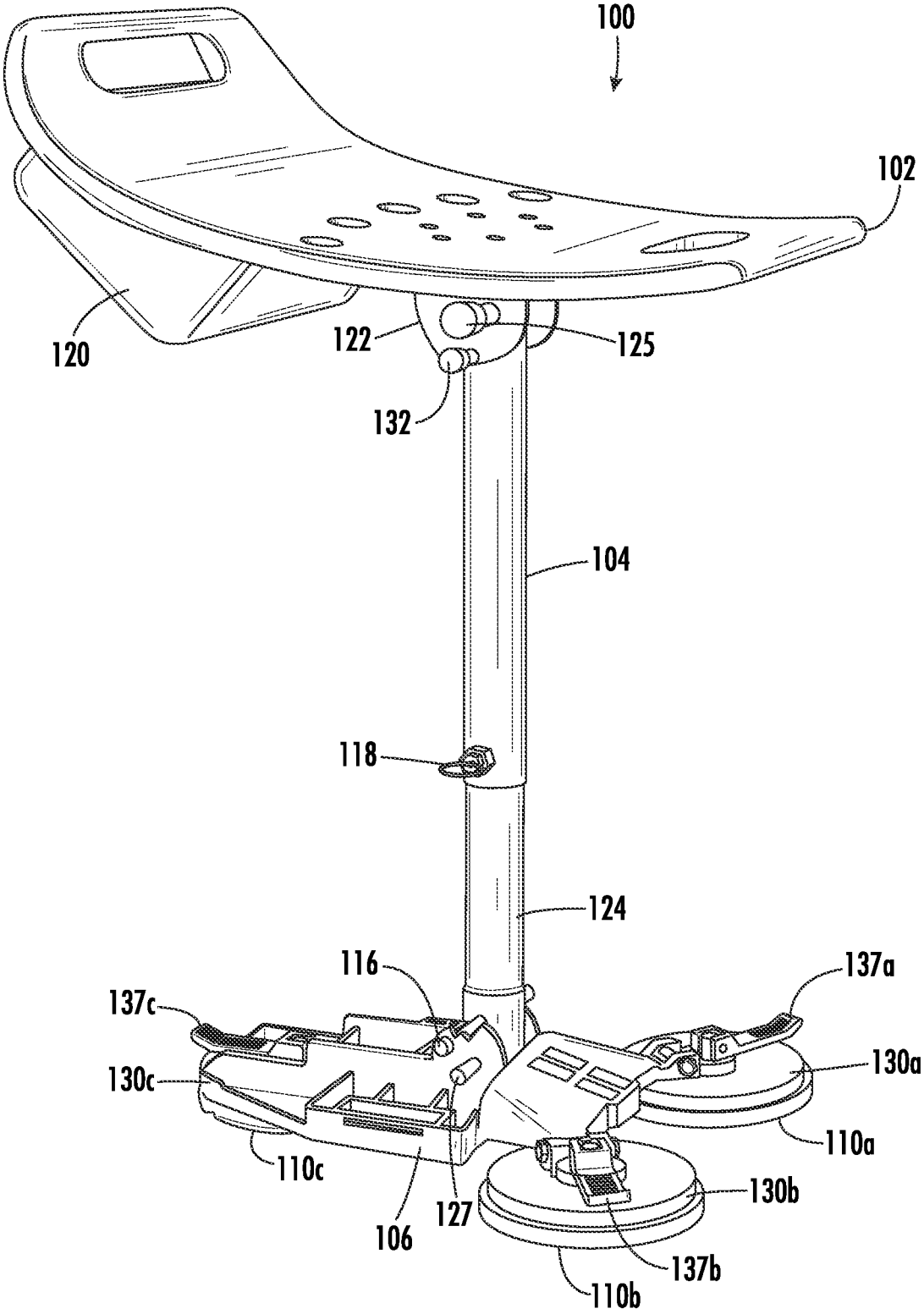
FIG. 1 is a perspective view of a standup paddleboard (SUP) seat assembly in which various aspects of the disclosure may be implemented.
Figure 2:
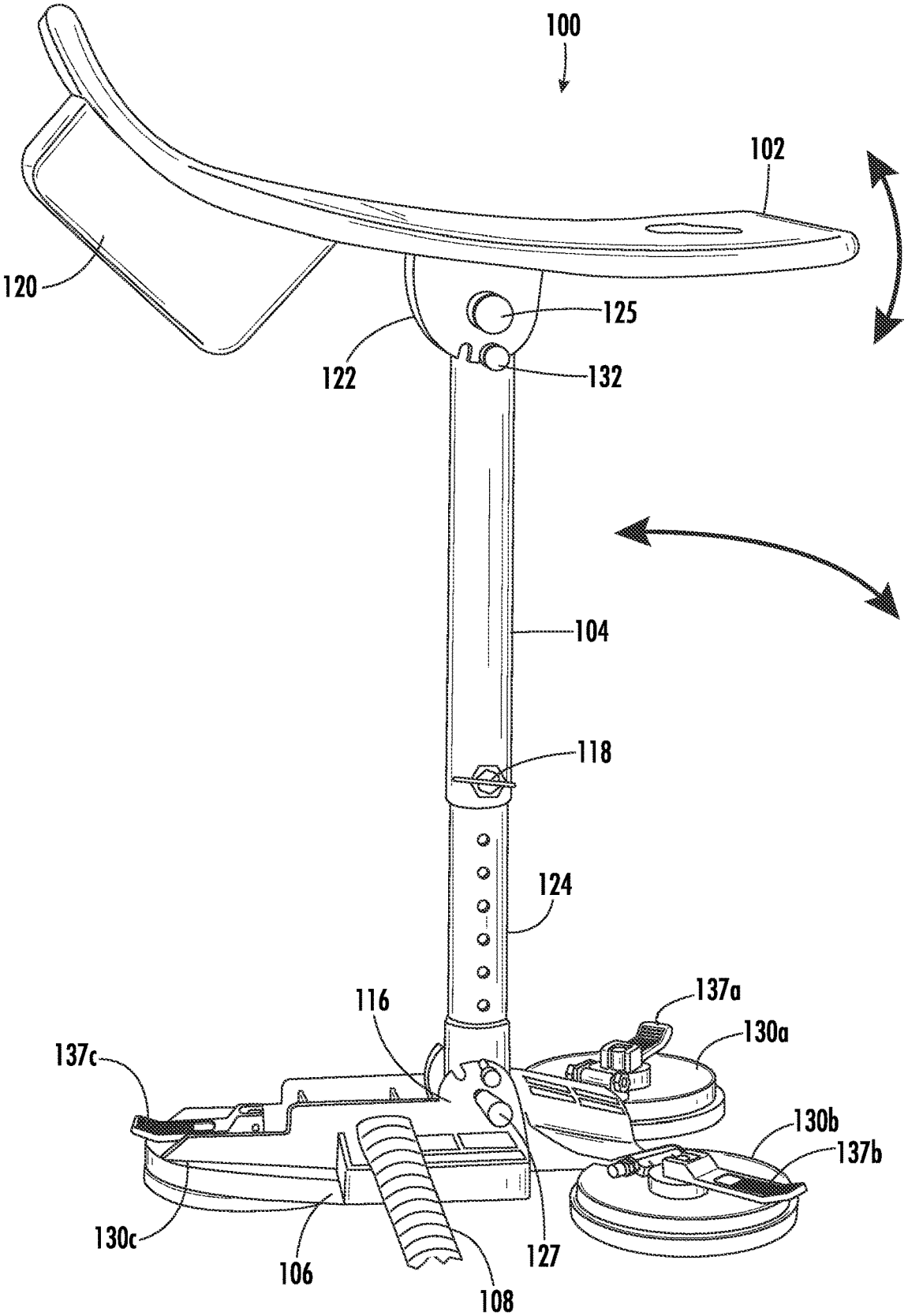
FIG. 2 is a side view of the seat assembly.
Figure 3:
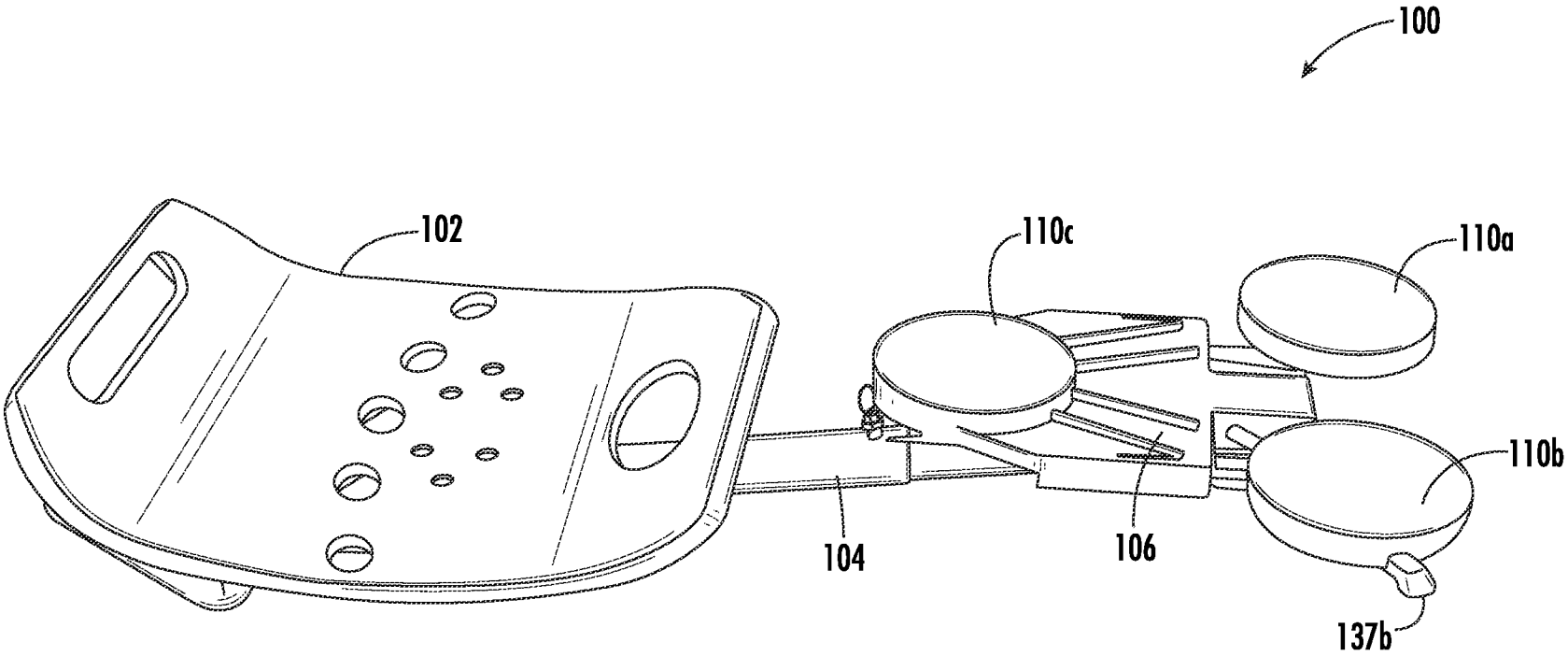
FIG. 3 is a bottom view of a portion of the seat assembly.

Referring now to FIGS. 1-3, a standup paddleboard (SUP) seat assembly, generally designated 100, includes a seat 102, mounted to an upper post 104. The seat may comprise textured plastic of carbon fiber, for example. The upper post 104 extends from a lower post 124 in order to adjust a height of the seat 102. The upper post and the lower post 124 may comprise anodized aluminum or carbon fiber, for example, for saltwater corrosion resistance. In addition, a storage bag 120 may be secured to the seat 102 to store personal items of the user when paddleboarding.

A base plate 106 is secured to the lower post 124 via bracket 116. The base plate 106 may comprise anodized aluminum or carbon fiber. The bracket 116 comprises a first side and a spaced apart second side having a bolt 127 extending therebetween, the lower post 124 is rotatable secured to the bracket 116 via the bolt 127 as shown in FIGS. 1 and 2. A post adjustment pin 133 can be loosened or pulled outward so that the lower post 124 will rotate and when the lower post 124 is at the desired angle, the post adjustment pin 133 can be tightened or released into a desired notch 139 to maintain the lower post 104 at the desired angle.

The base plate 106 has a shape to provide a sturdy foundation and may be longer than it is wide. The shape of the base plate 106 spreads the weight of the user more along the centerline and length of the SUP where the SUP is typically thicker and stronger versus to the edges of the SUP.

A strap 108 may be secured to the base plate 106 using one end of the strap 108 with a fixed loop to secure to an aperture 114 of the bracket 116. The opposing second end of the strap 108 has an adjustable locking buckle 112 in order to adjust the tension when securing the seat assembly 100 to the SUP. As those of ordinary skill in the art can appreciate, the strap 108 may be secured around the SUP using hook and loop or other types of fastening devices and is not limited to a locking buckle 112 described herein.

A plurality of suction cups 103*a*, 130*b*, 130*c*, each having a nonslip silicon pad 110*a*, 110*b*, 110*c*, is secured to a lower surface of the base plate 106 as shown in FIG. 3.

The plurality of suction cups 130*a*, 130*b*, 130*c* each comprise a respective lever 137*a*, 137*b*, 137*c* to create a vacuum between the plurality of suction cups 130*a*, 130*b*, 130*c* and the top surface of the SUP when the levers are pulled up.

The silicon pads 110*a*, 110*b*, 100*c* on the bottom of the suction cups are configured to be sandwiched between the SUP and the base plate 106 when the seat assembly 100 is secured to the SUP. The plurality of suction cups 130*a*, 130*b*, 130*c* is configured to secure the seat assembly 100 to the top surface of the SUP. Accordingly, the silicon pads 110*a*, 100*b*, 100*c* also serve as a cushion to prevent damage to the SUP. They also serve as a shock absorber for the user while sitting on the seat 102 and provides a softer seating experience for the user as the SUP moves through choppy water. The strap 108 is configured to be wrapped around the SUP and tightened using the locking buckle 114 to install the seat assembly 100 to the SUP.

Figure 4:
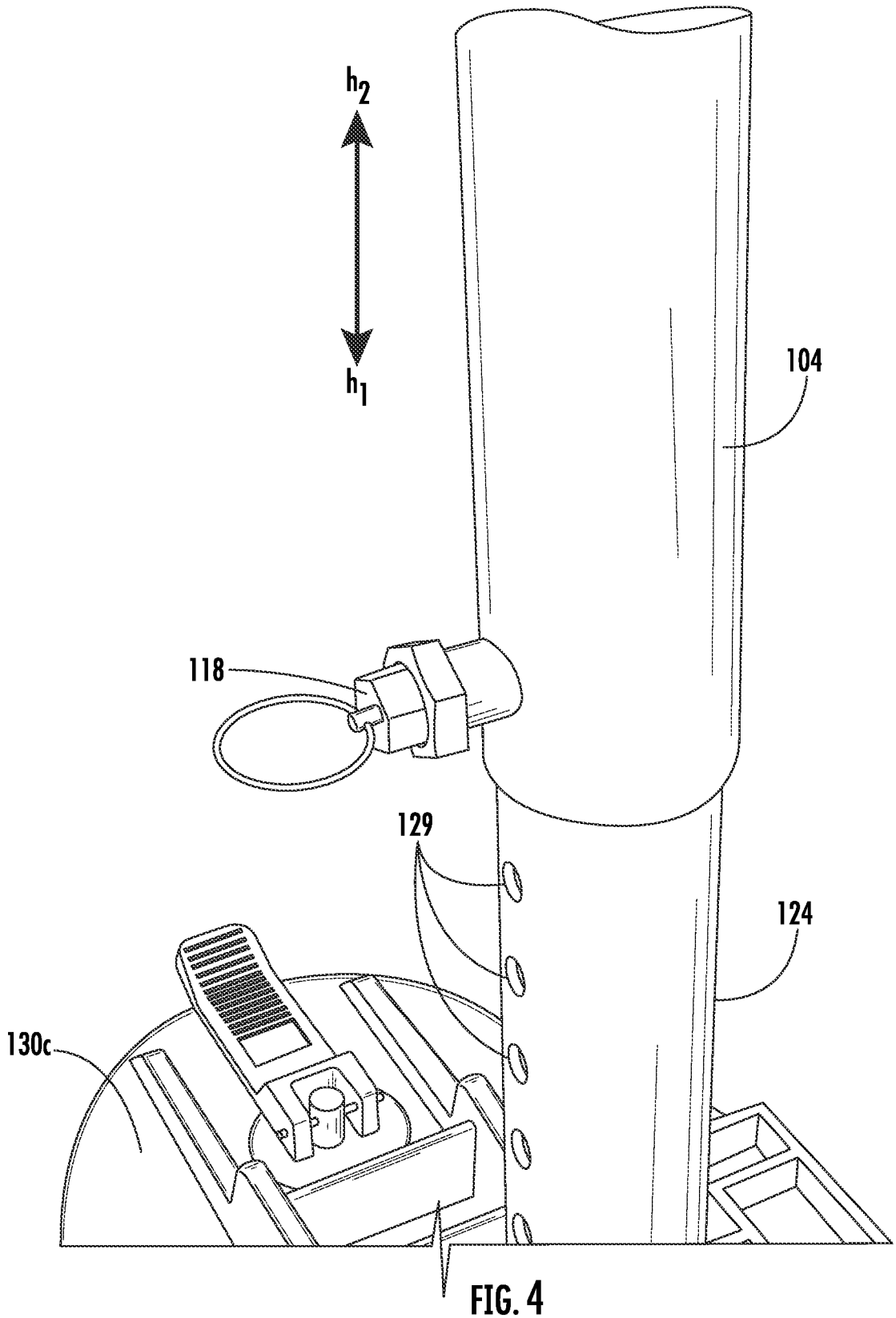
FIG. 4 is a detail view of the seat assembly illustrating a seat pivot adjustment range.

Referring now to FIG. 4, a seat bracket 122 is used to adjustably secure the seat 102 to the upper post 104. The seat bracket 122 includes a seat bolt 125 that can be used to tilt the seat 102 about a seat bolt 125 to a desired angle. A seat adjustment pin 132 can be tightened or released into a selected seat notch 135 to maintain the seat 102 at the desired angle.

Figure 5:
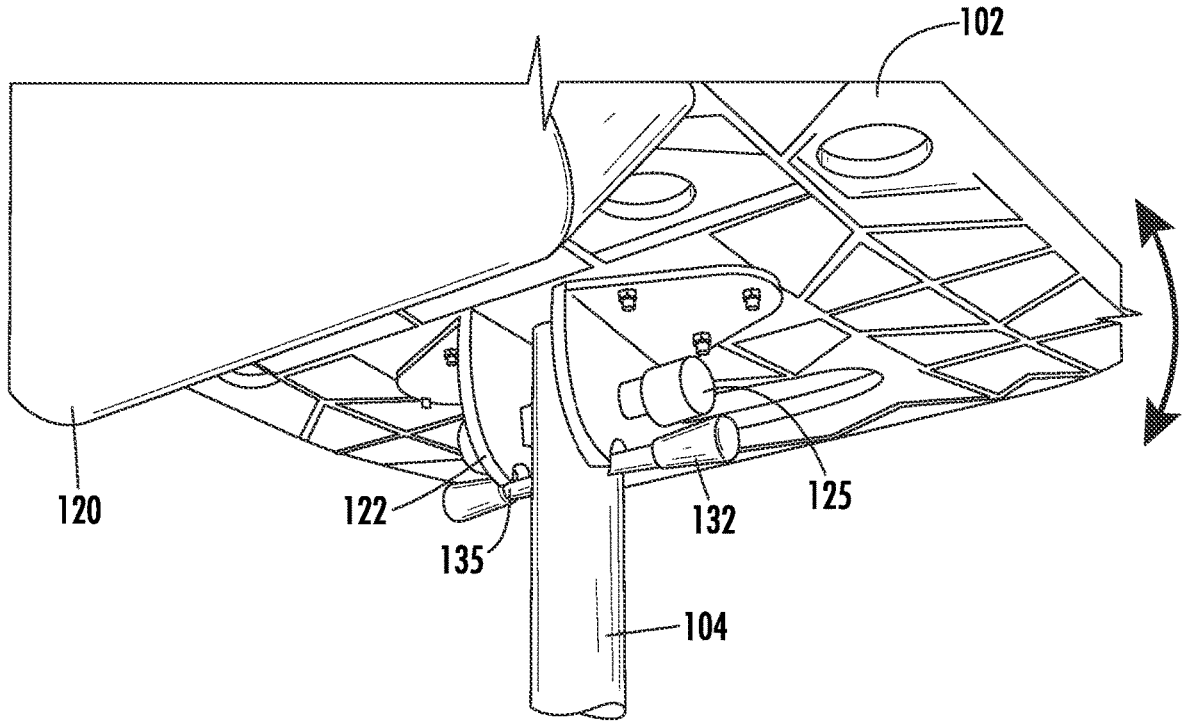
FIG. 5 is a detail view of an upper post and lower post of the seat assembly.

Referring now to FIG. 5, the seat 102 is typically in a lowered position in the direction of h1 as shown in FIG. 5 for the user to sit down. As explained above, the seat 102 can be raised so that the user can lean against it when standing up. In order to raise the seat 102, the height adjustment pin 118 is pulled back and the upper post 104 is pulled upwards in the direction h2 and extended from the interior of lower post 124. The adjustment pin 118 may comprise a spring-loaded return to prevent the adjustment pin 118 from being lost or separated from the upper post 104. Once the desired height is reached, the height adjustment pin 118 can be released so that it springs back and secures the upper post 118 in position and the seat 102 at the desired height.

Figure 6:
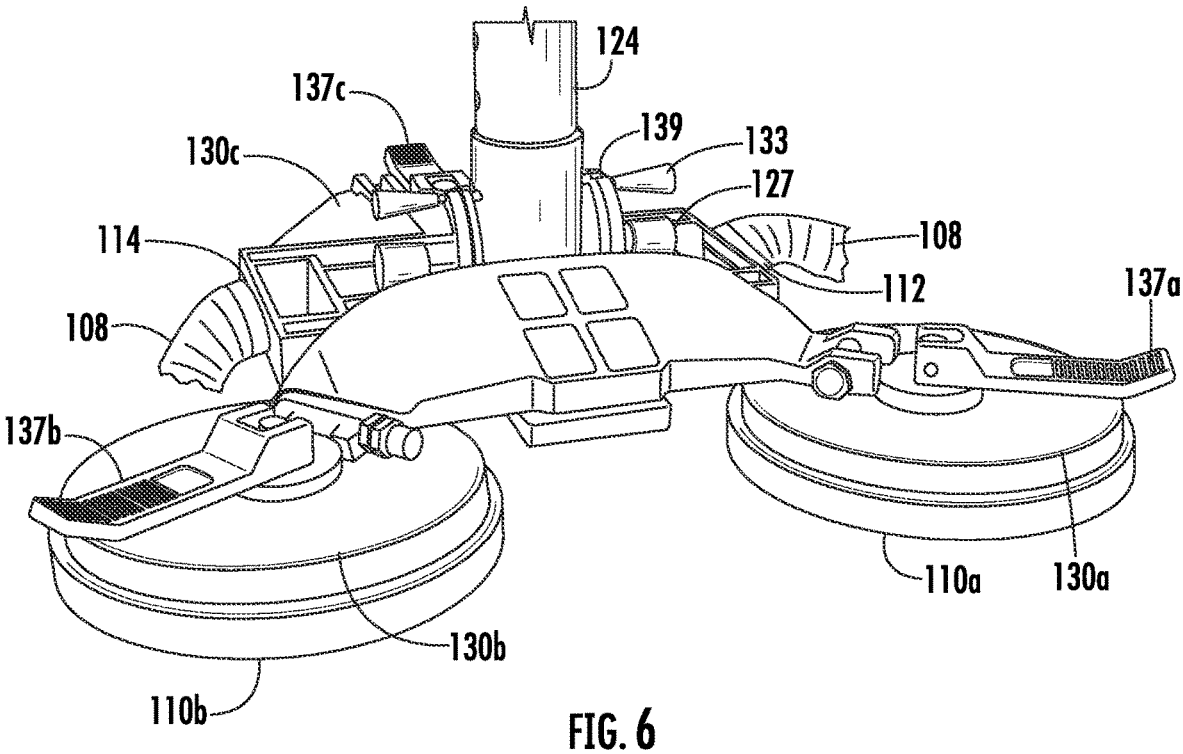
FIG. 6 is a detail view of a plurality of suction cups of the seat assembly of FIG. 1.

Referring now to FIG. 6, a detail view of a lower portion of the seat assembly is shown. As explained above, the plurality of suction cups 130*a*, 130*b*, 130*c* are used to secure the seat assembly to the SUP. The SUP may typically be greater than six feet in length to about thirteen feet.

Adjusting the angle of the seat 102 can be accomplished in two ways. The first way is by moving the combination of the lower post 124 and upper post 104 to which the seat 102 is secured atop. The bracket 116 comprises the bolt 127 so that the lower post 124 is rotatable secured to the bracket 116 via the bolt 127. The post adjustment pin 133 can be loosened so that the lower seat post 124 pivots about the bracket 116 relative to the SUP. The lower post 124 may rotate about thirty degrees relative to a vertical to the horizontal surface of the SUP. The post adjustment pin 133 can then be tightened in a selected notch 139 once the seat 102 is at the desired angle relative to the SUP.

The second way to adjust the angle of the seat 102 is to loosen the seat adjustment pin 132 and tilt the seat 102 to the desired angle and tighten back the seat adjustment pin 132 in the desired notch 135. This is described above in with reference to FIG. 5.

In use, the seat assembly 100 is secured to the SUP at approximately the middle portion of the SUP. The weight of the seat assembly 100 and a user is positioned on the SUP so that it is evenly distributed and the SUP will still float and glide properly when being paddled. The user is positioned in front of the seat assembly 100 facing towards a front of the SUP. The seat assembly 100 can be positioned in the lowered position so that the user can sit, and also in the raised position where the user 130 may lean against the seat 102. The user must keep his/her feet on the SUP in order to maintain the balance of the SUP as it floats in the water.

Figure 7:
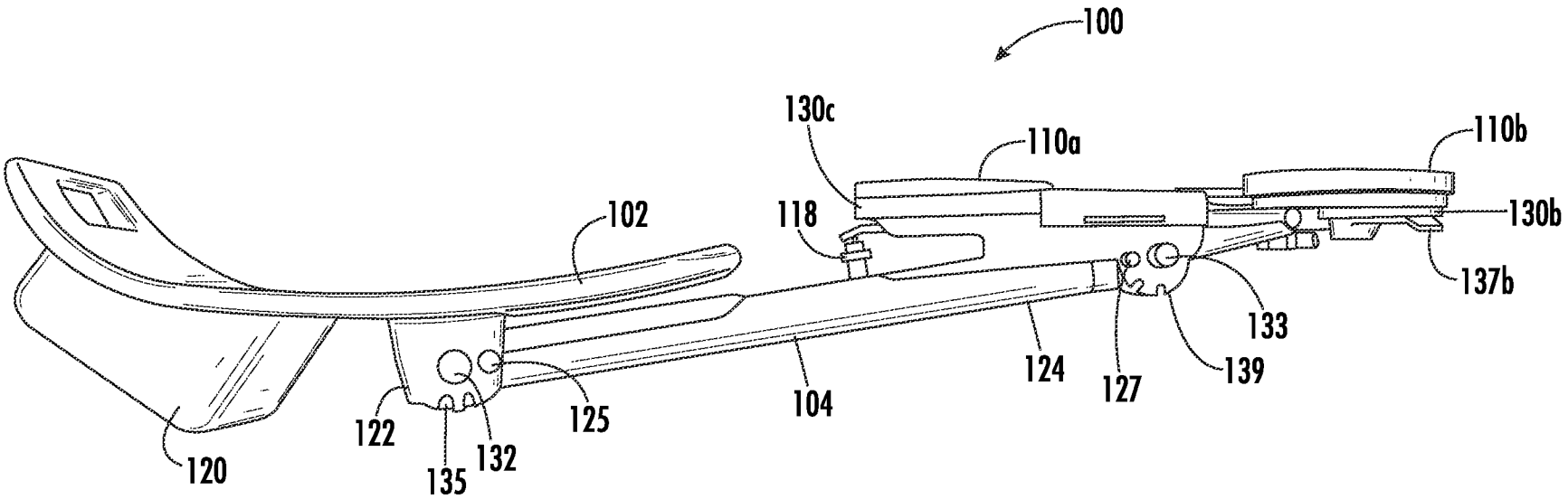
FIG. 7 is a side view of the seat assembly of FIG. 1 in a collapsed position for storage and transport.

Referring now to FIG. 7, the seat assembly 100 can be rotated and collapsed together to result in a mostly linear configuration of the seat assembly 100 for storing and transporting. In particular, the base 106 and the lower and upper posts 104, 124 are rotated together. Similarly, the seat 102 is rotated to the lower and upper posts 104, 124 to make a compact profile. The seat adjustment pin 125 and the post adjustment pin can be tightened to maintain the seat assembly 100 in the collapsed position. The length of the seat assembly 100 when collapsed together is about thirty three inches and about six inches in height making the seat assembly 100 easy to store and transport.

The previous description of the disclosed embodiments is provided to enable any person skilled in the art to make or use the disclosed embodiments. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope possible consistent with the principles and novel features as defined herein.

That which is claimed is:

1. A standup paddleboard (SUP) seat assembly comprising:

a seat having a horizontal portion configured for a user to sit;

an upper post having a height adjustment pin, wherein the seat is mounted on an upper end of the upper post;

a lower post, wherein the upper post is configured to extend from the lower post in order to adjust a height of the seat and be secured with the height adjustment pin;

a bracket secured to a lower end of the lower post;

a base plate having a lower surface and an upper surface, the base plate secured to the lower post via the bracket;

a plurality of suction cups secured to the lower surface of the base plate; and a strap having a first end and a second end, the strap secured to the base plate.

2. The SUP seat assembly of claim 1, wherein the strap comprises a first end and a second end, the strap secured to the base plate using the first end of the strap having a fixed loop and the opposing second end of the strap having a locking buckle.

3. The SUP seat assembly of claim 1, wherein the bracket comprises a first side and a spaced apart second side having a bolt extending therebetween, the lower post rotatable secured to the bracket via the bolt.

4. The SUP seat assembly of claim 1, wherein the plurality of suction cups comprise a nonslip material on a bottom thereof.

5. The SUP seat assembly of claim 1, further comprising a storage bag secured to the seat to store personal items of a user when paddleboarding.

6. The SUP seat assembly of claim 1, further comprising a seat bracket and seat bolt rotatably securing the upper post to the seat.

7. The SUP seat assembly of claim 1, wherein the plurality of suction cups each comprise a lever to create a vacuum.

8. The SUP seat assembly of claim 1, wherein the base plate having a rear portion, the strap being secured to the base plate at the rear portion and behind the bracket.

9. The seat assembly of claim 1, wherein the seat comprises textured plastic.

10. The seat assembly of claim 1, wherein the seat comprises carbon fiber.

11. The seat assembly of claim 1, wherein the lower post and the upper post each comprise anodized aluminum.

12. The seat assembly of claim 1, wherein the lower post and the upper post each comprise carbon fiber.

13. The seat assembly of claim 1, wherein the plurality of suction cups comprise three suction cups with two positioned forward of the lower post and one positioned rearward of the lower post.

14. A standup paddleboard (SUP) seat assembly comprising:

a seat;

a post having a lower end and an upper end, the upper end secured to the seat;

a bracket secured to the lower end of the post;

a base plate having a lower surface and an upper surface, the base plate secured to the post via the bracket;

a plurality of suction cups secured to the lower surface of the base plate; and a strap having a first end and a second end, the strap secured to the base plate.

15. The seat assembly of claim 14, wherein the post comprises an upper post and a lower post, the upper post configured to extend from the lower post in order to adjust a height of the seat and be secured with the height adjustment pin.

16. The SUP seat assembly of claim 14, wherein the strap is secured to the base plate using the first end of the strap having a fixed loop and the opposing second end of the strap having a locking buckle.

17. The SUP seat assembly of claim 14, wherein the plurality of suction cups each comprise a lever to create a vacuum.

18. The SUP seat assembly of claim 14, wherein the seat bracket further comprises a plurality of notches to adjust an angle of the seat.

19. A standup paddleboard (SUP) seat assembly comprising:

a seat having a horizontal portion configured for a user to sit;

an upper post having a height adjustment pin, wherein the seat is mounted on an upper end of the upper post;

a lower post, wherein the upper post is configured to extend from the lower post in order to adjust a height of the seat and be secured with the height adjustment pin;

a bracket secured to a lower end of the lower post;

a base plate having a lower surface and an upper surface, the base plate secured to the lower post via the bracket;

a plurality of suction cups secured to the lower surface of the base plate; and a strap having a first end and a second end, the strap secured to the base plate;

wherein the strap comprises a first end and a second end, the strap secured to the base plate using the first end of the strap having a fixed loop and the opposing second end of the strap having a locking buckle; and wherein the bracket comprises a first side and a spaced apart second side having a bolt extending therebetween, the lower post rotatable secured to the bracket via the bolt.

20. The SUP seat assembly of claim 19, wherein the plurality of suction cups each comprise a lever to create a vacuum.

* * * * *